US006529696B2

(12) United States Patent
Kuwabara

(10) Patent No.: US 6,529,696 B2
(45) Date of Patent: Mar. 4, 2003

(54) IMAGE FORMING APPARATUS HAVING VARIABLE SHEET-CONVEYING SPEED

(75) Inventor: Yoshihiro Kuwabara, Koshigaya (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/982,014

(22) Filed: Oct. 19, 2001

(65) Prior Publication Data

US 2002/0048465 A1 Apr. 25, 2002

(30) Foreign Application Priority Data

Oct. 20, 2000 (JP) ..... 2000-320999

(51) Int. Cl.[7] ..... G03G 15/20
(52) U.S. Cl. ..... 399/68; 219/216; 399/69
(58) Field of Search ..... 399/68, 69, 70, 399/67; 219/216; 347/156; 430/124

(56) References Cited

U.S. PATENT DOCUMENTS

| | | | | |
|---|---|---|---|---|
| 5,724,630 A | | 3/1998 | Mashiba | 399/70 |
| 5,768,655 A | | 6/1998 | Yoshino et al. | 399/69 |
| 5,987,274 A | | 11/1999 | Satoh | 399/69 |
| 6,336,010 B1 | | 1/2002 | Kuwabara | 399/68 |
| 2002/0012543 A1 | * | 1/2002 | Nakamura et al. | 399/69 |

FOREIGN PATENT DOCUMENTS

| | | | |
|---|---|---|---|
| JP | 2-120781 | | 5/1990 |
| JP | 10-198214 | * | 7/1998 |
| JP | 10-233276 | * | 9/1998 |
| JP | 2000-181275 | * | 6/2000 |
| JP | 2001-154533 | * | 6/2001 |

OTHER PUBLICATIONS

Patent Abstracts of Japan, JP 2000–131997, May 12, 2000.

* cited by examiner

*Primary Examiner*—Sophia S. Chen
(74) *Attorney, Agent, or Firm*—Oblon, Spivak, McClelland, Maier & Neustadt, P.C.

(57) ABSTRACT

An image forming apparatus of the present invention includes a thermal fixing unit and is capable of varying a sheet conveying speed. The sheet conveying speed is varied in accordance with a resolution selected. The target fixing temperature of the fixing unit is variable in accordance with the sheet conveying speed. Further, the stand-by temperature of the fixing unit after image formation is set in accordance with the resolution selected to thereby control a temperature. This successfully reduces the operator's waiting time and applies adequate heat to a sheet.

10 Claims, 10 Drawing Sheets

HOST
50
1
21
PRINTER CONTROLLER
25
24
OPERATION PANEL
27
28
29
RAM
ROM
EEP ROM
WRITING UNIT
31
I/O INTERFACE
CPU
26
SEQUENCE UNITS
32
DIP/SW
30
SENSORS
33
23
22

IMAGE FORMING APPARATUS HAVING VARIABLE SHEET-CONVEYING SPEED

BACKGROUND OF THE INVENTION

1. Field of the Invention

The present invention relates to a copier, printer, facsimile apparatus or similar image forming apparatus.

2. Description of the Background Art

Optics included in an image forming apparatus has been improved in various ways in order to meet an increasing demand for higher resolutions. However, to implement different resolutions with a single sheet conveying speed, optics with an advanced function is essential, resulting an increase in cost. In light of this, some image forming apparatuses are configured to realize a high resolution by varying the sheet conveying speed. For example, the sheet conveying speed is halved to double the resolution, as proposed in the past.

As for an electrophotographic image forming apparatus, a thermal fixing device is extensively used that fixes a toner image formed on a paper sheet, OHP (OverHead Projector) film or similar sheet-like recording medium. It is a common practice with a thermal fixing device to press a press roller against a heat roller, which is heated by a heater or heat source accommodated therein. The heat roller and press roller fix a toner image on a sheet with heat and pressure while conveying the sheet. In this type of thermal fixing device, heat generated by the heater for a unit time is usually controlled to maintain the surface temperature of the heat roller at a preselected fixing temperature so as to apply adequate heat to a sheet being conveyed via a nip between the two rollers. If the heat applied to the toner image is excessive, then toner grains are melted by heat to bring about a spot-off problem or the sheet creases. If the heat is short, defective fixation occurs due to the insufficient softening of toner grains.

As stated above, if the condition of the fixing temperature is not varied when the sheet conveying speed is varied to implement a high resolution, then spot-off and creasing or defective fixation occurs due to the variation of heat applied to a sheet.

To solve the above problem, a target fixing temperature may be raised when the sheet conveying speed is high, i.e., when the resolution is low or lowered when the sheet conveying speed is low, i.e., when the resolution is high. This kind of scheme, however, brings about another problem that at the time when the sheet conveying speed is varied, fixation has already started or a sheet has already been driven out of the apparatus. The resulting excessive heat or short heat renders the resulting image defective. While sheet feed may begin after the temperature has reached a target fixing temperature, the operator of the apparatus must simply waste such a period of time, resulting in low productivity.

The problem discussed above also occurs with temperature control to be executed in the stand-by state of the apparatus. Specifically, it has been customary with an image forming apparatus operable with different sheet conveying speeds to selectively set up a particular fixing temperature and a particular sheet conveying speed for each of a low resolution and a high resolution. Generally, the low resolution is frequently used while the high resolution is assigned to special prints needing high quality. As for a stand-by state, to reduce the waiting time until the output of the first copy, a single, relatively high fixing temperature is assigned to the fixing unit in matching relation to the low resolution (high fixing temperature), which is more frequently used than the high resolution. For example, while fixing temperatures of 180° C. (low resolution or high sheet conveying speed) and 140° C. (high resolution or low sheet conveying speed) are available for sheet feed, only a stand-by temperature of 160° C. is available for the stand-by state. In this case, a person desiring the low sheet conveying speed must simply wait until the fixing unit has been cooled off to the adequate fixing temperature of 140° C. This critically lowers the productivity of the apparatus.

Technologies relating to the present invention are disclosed in, e.g., Japanese Patent Laid-Open Publication No. 2-120781.

SUMMARY OF THE INVENTION

It is an object of the present invention to provide an image forming apparatus capable of varying a sheet conveying speed and yet applying adequate heat to a sheet while reducing a waiting time.

An image forming apparatus of the present invention includes a thermal fixing unit and is capable of varying a sheet conveying speed. The sheet conveying speed is varied in accordance with a resolution selected. The target fixing temperature of the fixing unit is variable in accordance with the sheet conveying speed. Further, the stand-by temperature of the fixing unit after image formation is set in accordance with the resolution selected to thereby control a temperature. This successfully reduces the operator's waiting time and applies adequate heat to a sheet.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
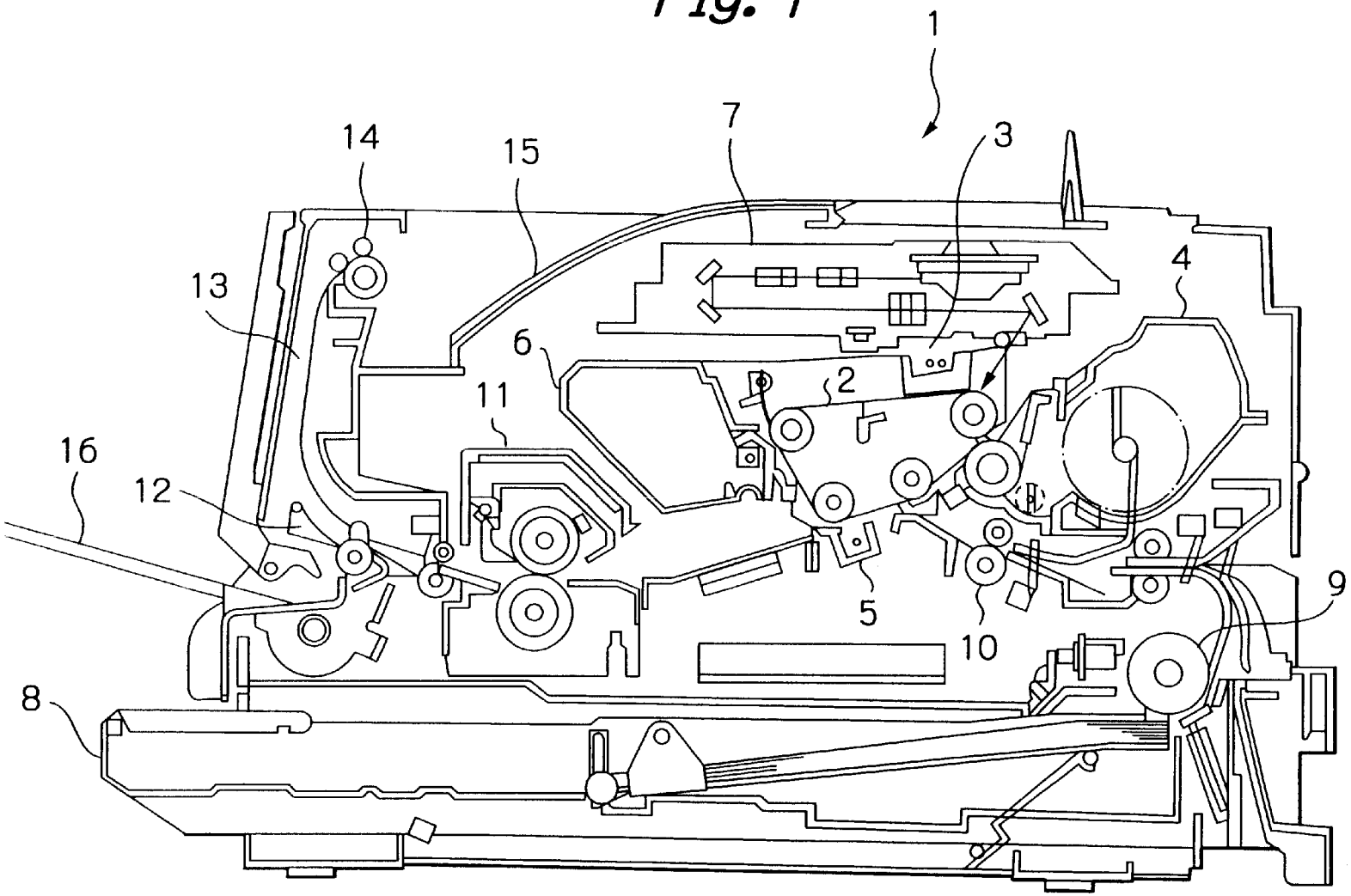
FIG. 1 is a section showing the general construction of an image forming apparatus embodying the present invention.

Referring to FIG. 1 of the drawings, an image forming apparatus embodying the present invention is shown and implemented as a laser printer by way of example. As shown, the laser printer, generally 1, includes a photoconductive belt or image carrier (simply belt hereinafter) 2 positioned at substantially the center of the printer. A main charger 3, a developing unit 4, an image transfer charger 5 and a cleaning unit 6 are sequentially arranged around the belt 2 in this order in the direction of movement of the belt 2, i.e., clockwise as viewed in FIG. 1. An optical writing unit 7 is positioned above the belt 2. A sheet cassette 8 is removably accommodated in the lower portion of the printer body and loaded with a stack of sheets.

In operation, the main charger 3 uniformly charges the surface of the belt 2, which is turning clockwise. The optical writing unit 7 scans the charged surface of the belt 2 with a laser beam in accordance with image data, thereby forming a latent image on the belt 2. The developing unit 4 develops the latent with toner to thereby produce a corresponding toner image.

A pickup roller 9 pays out the top sheet from the sheet cassette 8 toward a registration roller pair 10. The registration roller pair 10 once stops the sheet and then conveys it to a position below the belt 2 at a preselected timing. The image transfer charger 5 transfers the toner image from the belt 2 to the sheet. The sheet with the toner image is conveyed to a fixing unit 11. After the image transfer, the cleaning unit 6 removes the toner left on the belt 2.

The fixing unit 11 fixes the toner image on the sheet. A solenoid-operated FD/FU (Face-UP/Face-Down) path selector 12 steers the sheet coming out of the fixing unit 11 to either one of a face-down print tray 15 and a face-up print tray 16. Specifically, a face-down outlet roller pair 14 conveys the sheet introduced into a face-down path 13 by the path selector 12 to the face-down print tray 15 face down, i.e., with the image surface of the sheet facing downward. The sheet not steered into the face-down path 13 is directly driven out to the face-up print tray 16.

Figure 2:
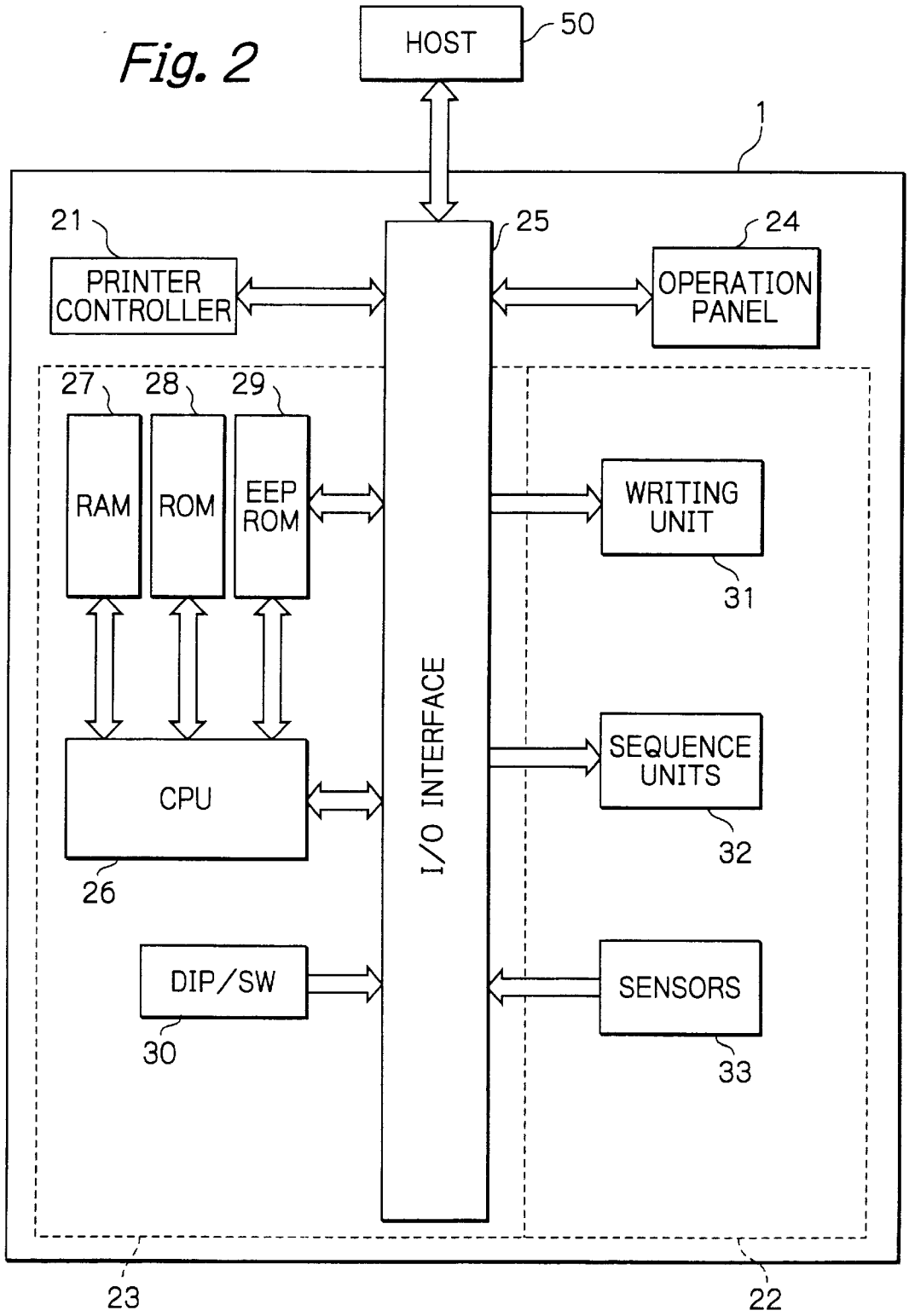
FIG. 2 is a schematic block diagram showing a control system included in the illustrative embodiment.

FIG. 2 shows a control system included in the illustrative embodiment. As shown, the control system includes a printer controller 21 for controlling image formation, an engine 22 for forming images, an engine control board 23 for controlling the engine 22, and an operation panel 24. The printer body 1 is connected to a host computer or similar host 50 via an I/O (Input/Output) interface 25 in order to interchange data with the host 50.

A CPU (Central Processing Unit) 26, a RAM (Random Access Memory) 27, a ROM (Read Only Memory) 28, an EEPROM (Electrically Erasable Programmable ROM) 29, a DIP/SW 30 and so forth are mounted on the engine control board 23. The CPU 26 controls the entire engine 22 in accordance with a program stored in the ROM or program ROM 28, a mode command input on the operation panel 24, and a command output from the inter controller 21. The RAM 27 plays the role of a work memory for the CPU 26 and an input buffer for input data. The EEPROM 29 is a nonvolatile memory that stores the error history of the engine 22 and the contents of mode commands input on the operation panel 24. The DIP/SW 30 is representative of a dip switch for allowing the operator of the printer to select a desired engine control mode.

The engine 22 includes a laser writing unit 31, various sequence units 32, various sensors 33 and so forth. The laser writing unit 31 includes a laser diode, a polygon motor and so forth, although not shown specifically. The sequence units 32 deal with an engine sequence relating to a fixing system, a developing system, and a driving system. The sensors 33 are responsive to conditions on sheet paths as well as sequence conditions.

Figure 3:
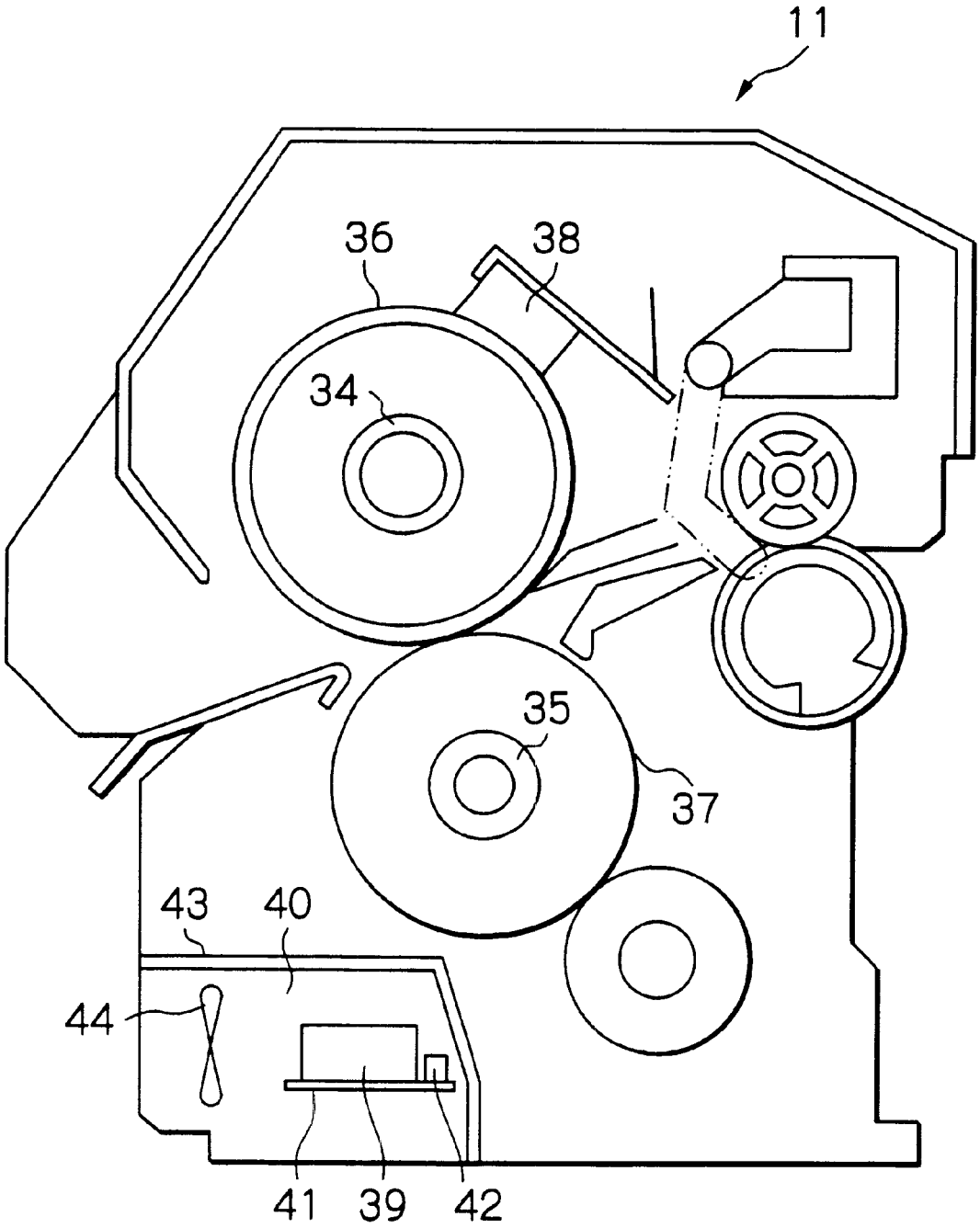
FIG. 3 is a section showing a fixing unit also included in the illustrative embodiment.

FIG. 3 shows a specific configuration of the fixing unit 11. As shown, the fixing unit 11 includes an upper and a lower fixing roller 36 and 37 accommodating lamps or heaters 34 and 35, respectively. A thermistor 38 is held in contact with the upper fixing roller 36 for sensing the surface temperature of the fixing roller 36. The thermistor 38 outputs temperature information necessary for controlling the surfaces of the fixing rollers 36 and 37 to a preselected fixing temperature.

The fixing unit 11 additionally includes a memory 39 storing information particular to the fixing unit 11. The memory 39 is implemented by an EEPROM or a nonvolatile memory backed up by a battery. Further, information can be written to or read out of the memory 39, as needed. When the fixing unit 11 is mounted to the printer body 1, the memory 39 is connected to the CPU 26, FIG. 2, mounted on the printer body 1. In this condition, the CPU 26 can read information particular to the fixing unit 11 out of the memory 39 and execute control based on the above information. In addition, the CPU 26 may write information in the memory 39 and use it later. This configuration allows the CPU 26 to determine whether or not the number of times of use of the fixing unit 11 stored in the memory 39 has reached a value corresponding to the life of the fixing unit 11.

The memory 39 is mounted on a circuit board 41 together with a thermistor 42. The circuit board 41 is positioned in a chamber 40 isolated from the fixing rollers 36 and 37 by a heat-insulating wall 43. A fan 44 is also disposed in the chamber 40 in order to cool off the circuit board 41 when temperature around the circuit board 41 rises above a preselected temperature, as determined by the thermistor 42.

Figure 4:
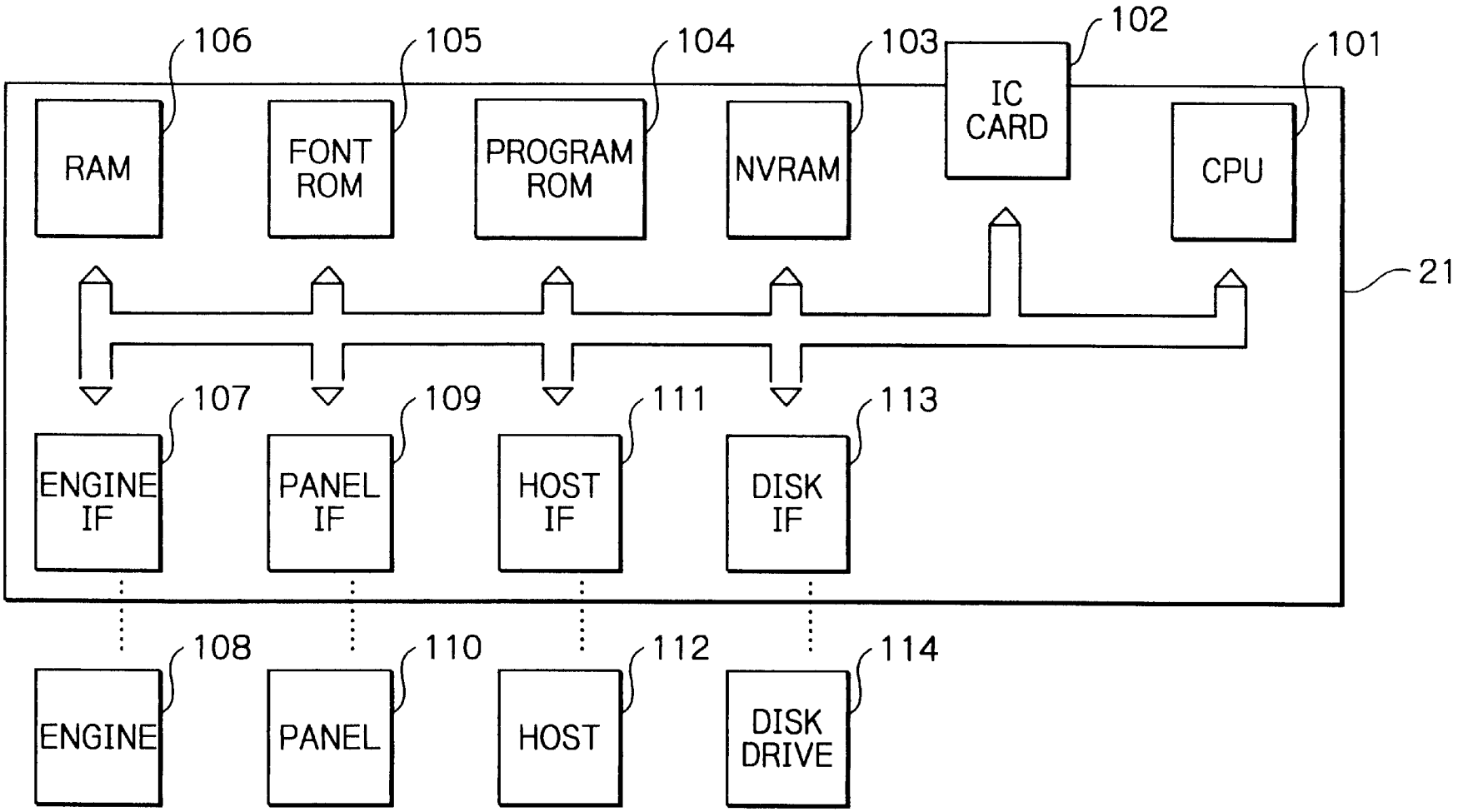
FIG. 4 is a schematic block diagram showing a specific configuration of a printer controller further included in the illustrative embodiment.

FIG. 4 shows the printer controller 21 in detail. As shown, the printer controller 21 includes a CPU 101, an NVRAM (NonVolatile Random Access Memory) 103, a program ROM 104, a font ROM 105, a RAM 106, an engine IF (InterFace) 107, a panel IF 109, a host IF 111, a disk IF 113, and so forth. An IC (Integrated Circuit) card 102 may be mounted to the printer controller 21.

The CPU 101 controls the entire printer controller 21 in accordance with a program stored in the program ROM 104 or in response to a mode command input on a panel or a command output from a host 112. The IC card 102 provides the printer controller 21 with font data and a program when mounted to the printer controller 21. The NVRAM 103 stores the contents of, e.g., mode commands input on the panel 110.

The program ROM 104 stores a control program to be executed by the printer controller 21. The font ROM 105 stores pattern data representative of fonts. The RAM 106 selectively plays the role of a work memory for the CPU 101, the role of an input buffer for input data, the role a page buffer for print data or the role of a memory for downloaded fonts.

The engine IF 107 allows the printer controller 21 to send commands, statuses and print data to the engine 108. The engine 108 prints images on sheets. The panel IF 109 allows the printer controller 21 and panel 110 to interchange commands and statuses. The panel 110 allows the operator to input a desired print mode or to see the current statuses of the printer.

The host IF 111 allows the printer controller 21 to interchange information with the host 112 and is usually implemented by an interface having Centronics specifications or an RS232C board. The host 112 is a host computer or similar host connected to the laser printer 1. The disk IF 113 communicates with a disk drive 114. The disk drive 114 may be implemented as a floppy disk drive or a hard disk drive that stores various data and print data and a program.

When the printer controller 21 receives text information or graphic information from the host 112, it analyzes the information and then sequentially writes print data in the page buffer of the RAM 106 page by page. The page-by-page print data are read out of the RAM 106 and sent to the engine 108 via the engine IF 107 to be printed out thereby.

The illustrative embodiment is capable of varying a sheet conveying speed in order to cope with a high resolution. For example, the illustrative embodiment lowers a linear velocity of 92 mm/sec for a resolution of 600 dpi (dots per inch) to 46 mm/sec for a resolution of 1,200 dpi. At the same time, the illustrative embodiment assigns a target fixing temperature of 180° C. to 92 mm/sec and a target fixing temperature of 140° C. to 46 mm/sec.

Figure 5:
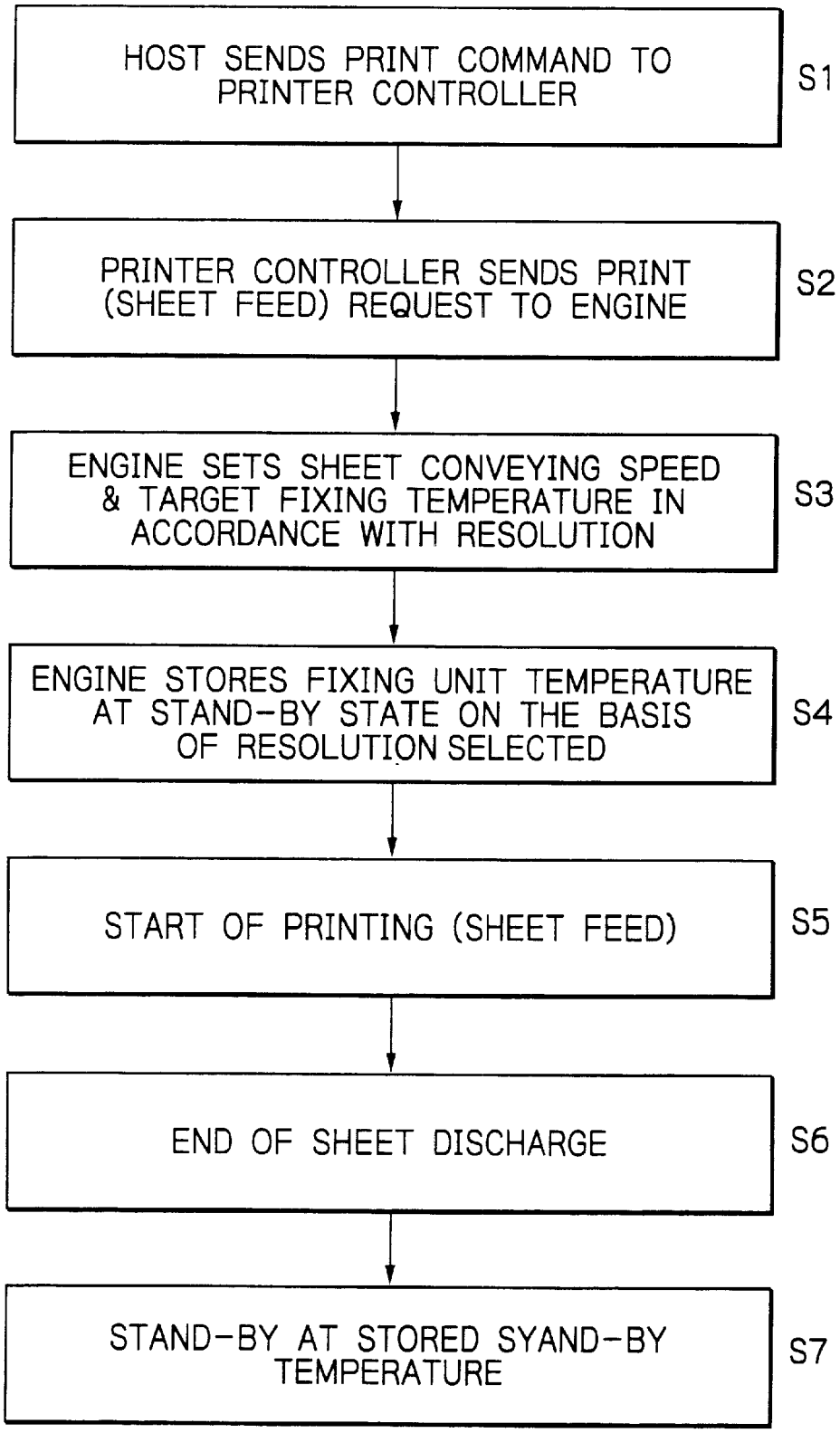
FIG. 5 is a flowchart demonstrating a specific operation of the illustrative embodiment.
Figure 6:
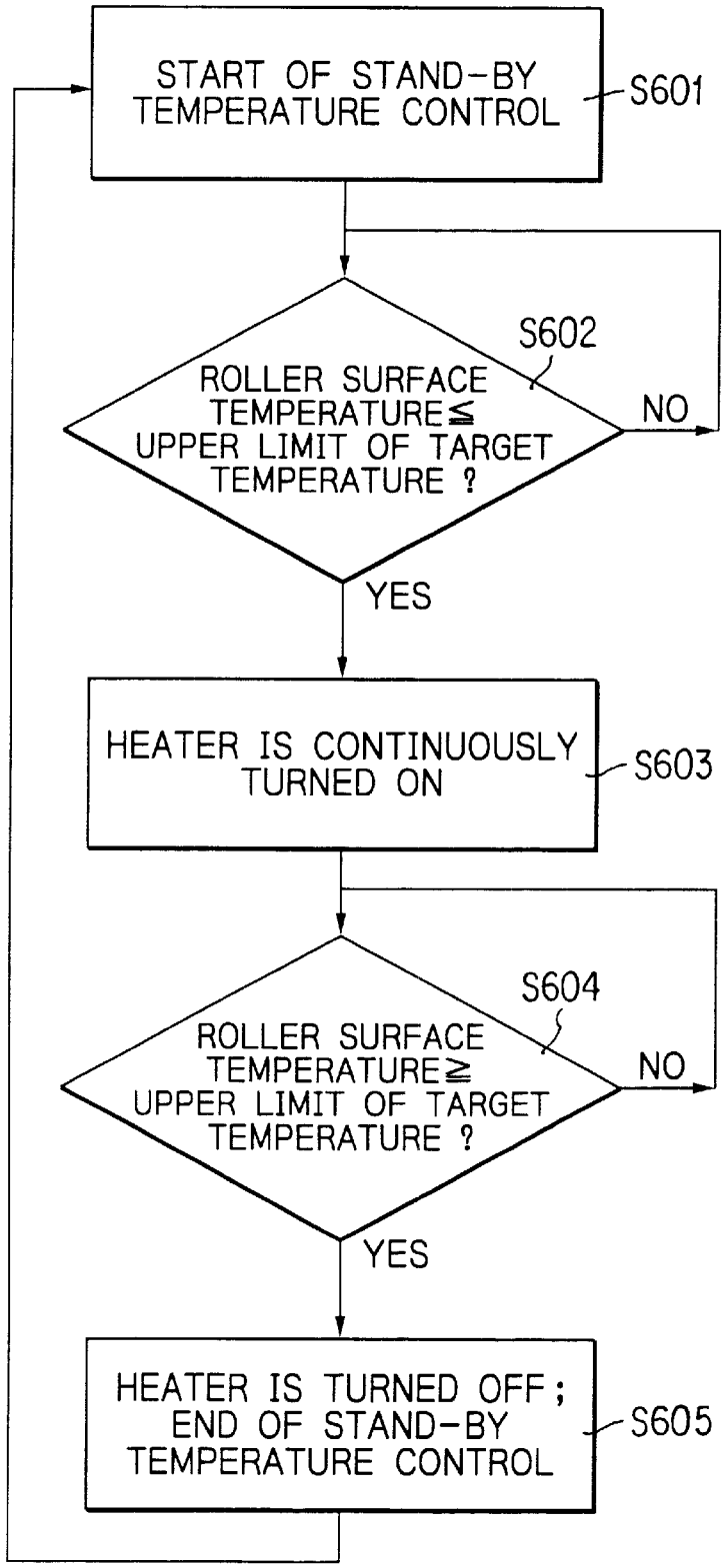
FIG. 6 is a flowchart showing part of the operation of FIG. 5 in detail.

Reference will be made to FIGS. 5 and 6 for describing a specific procedure unique to the illustrative embodiment for varying the fixing roller temperature in a stand-by state. Let this temperature be referred to as a target stand-by temperature. As shown in FIG. 5, assume that the printer controller 21 receives a print request from the host 50 (step S1). Then, the printer controller 21 issues print parameter information including resolution information to the engine 22 (step S2). In response, the engine 22 sets a sheet conveying speed or linear velocity and a target roller surface temperature (step S3) and then writes a fixing unit temperature (roller temperature) assigned to a stand-by state in the EEPROM 29 (step S4). As for the temperature to be written to the EEPROM 39, there can be selected a stand-by temperature matching with a resolution frequently selected in the past on the basis of the current resolution and past resolutions selected. Stated another way, a stand-by temperature matching with the operation environment can be selected. After the fixing temperature has been varied, if necessary, a printing cycle begins (step S5). After the discharge of a sheet (step S6), the engine 22 sets up the stand-by temperature stored in the EEPROM 29 (step S7).

FIG. 6 shows the temperature control executed in step S7 more specifically. As shown, at the start of temperature control (step S601), whether or not the surface temperature of the fixing rollers 36 and 37 is lower than the target stand-by temperature, more specifically, the lower limit thereof, is determined (step S602). If the answer of step S602 is positive, then the heaters 34 and 35 are continuously turned on (step S603). Subsequently, whether or not the above surface temperature has risen to the upper limit of the target temperature is determined (step S604). If the answer of step S604 is positive, then the heaters 34 and 35 are turned off (step S605). In this manner, the fixing unit temperature in the stand-by state is varied on the basis of the past sheet conveying speeds and past resolutions selected. Therefore, the probability that a target fixing temperature selected for the next printing operation is an adequate stand-by temperature is high. This successfully reduces the operator's waiting time.

The illustrative embodiment varies the target stand-by temperature in accordance with the past conditions of use of the fixing unit, as stated above. However, selecting a stand-by fixing unit temperature matching with a desired sheet conveying speed (resolution) brings about the following problem. Assume that a plurality of persons share the laser printer 1 as in a network environment. Then, although the conditions in which the laser printer 1 is operated may not be far different from each other, the waiting time may be relatively long for some persons. Another specific procedure will be described hereinafter that varies the stand-by temperature stepwise by taking account of resolutions selected by a plurality of persons.

Figure 7:
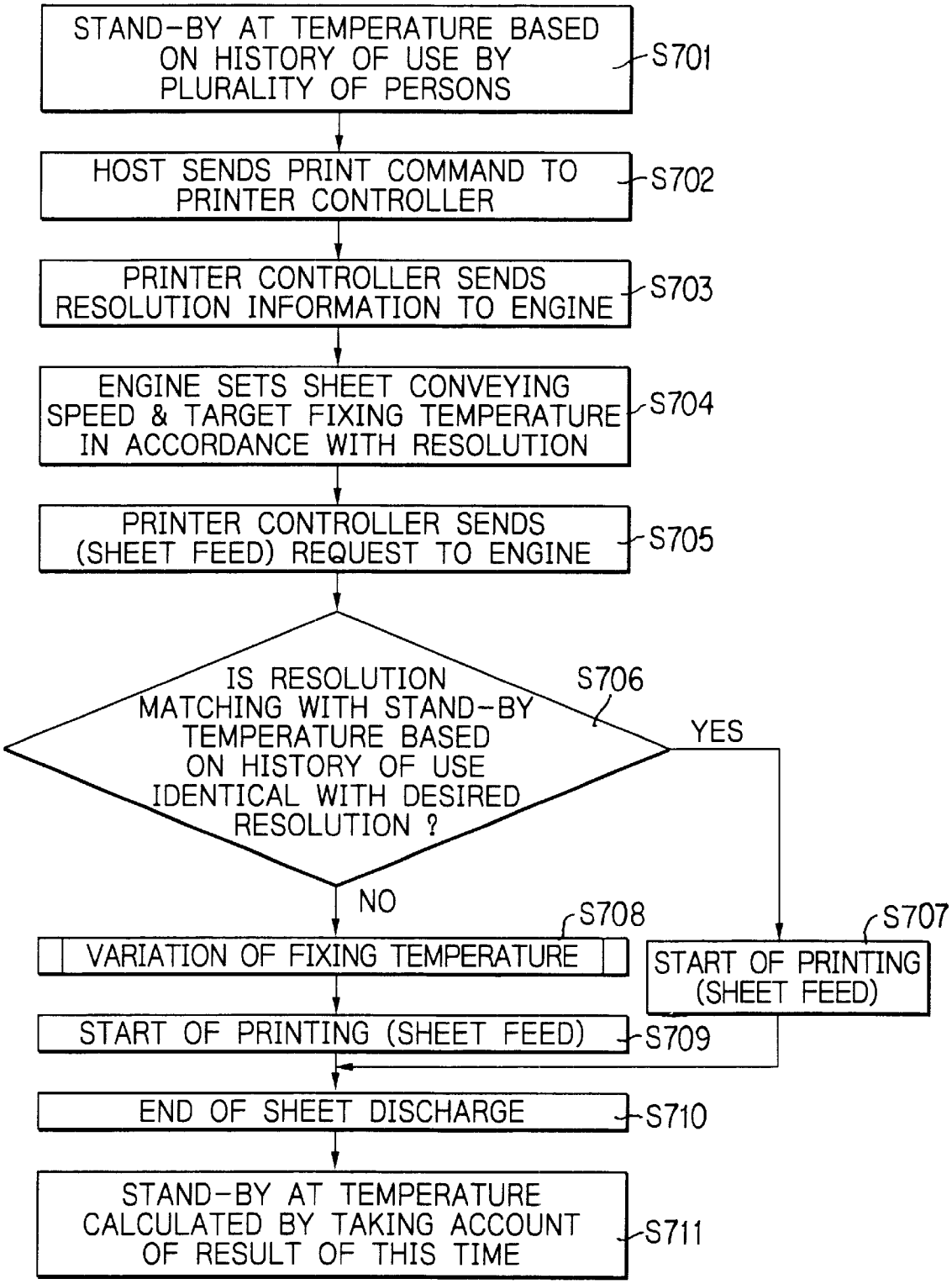
FIG. 7 is a flowchart showing another specific operation of the illustrative embodiment.

Referring to FIG. 7, after the power-up of the printer, the engine 22 sets up a stand-by state at a temperature calculated from the history of use by a plurality of users (step S701). Specifically, the engine 22 sets up a stand-by temperature on the basis of the frequency of use by the individual person. More specifically, assume that ten persons share the laser printer 1, and six of them use the resolution of 1,200 dpi, while the rest use the resolution of 600 dpi. Then, because the stand-by temperatures optimal for the resolutions of 1,200 dpi and 600 dpi are 140° C. and 160° C., respectively, the actual stand-by temperature calculated and set is:

$$(140\times6+160\times4)/10=148^\circ\ \text{C.}$$

In response to a print request from the host 50 (step S702), the printer controller 21 issues resolution information to the engine 22 (step S703). In response, the engine 22 sets a sheet conveying speed and a target roller surface temperature (step S704). Subsequently, printer controller 21 issues a print and sheet feed request to the engine 22 (step S705). Whether or not a resolution calculated from the history of use and corresponding to the stand-by temperature is identical with the desired resolution is determined (step S706). If the answer of the step S706 is positive (Y), then a printing cycle begins (step S707). If the answer of the step S706 is negative (N), the fixing temperature is varied (step S708). The step S708 is followed by a step S709 for starting a printing cycle. After a sheet or print has been driven out of the printer (step S710), the engine 22 sets up a stand-by temperature newly calculated by taking account of the result of this time of operation (step S711). This specific procedure is also practicable with the configuration shown in FIGS. 1 through 4 and shares of the sequence of steps of FIG. 6 with the previous specific procedure.

Figure 8:
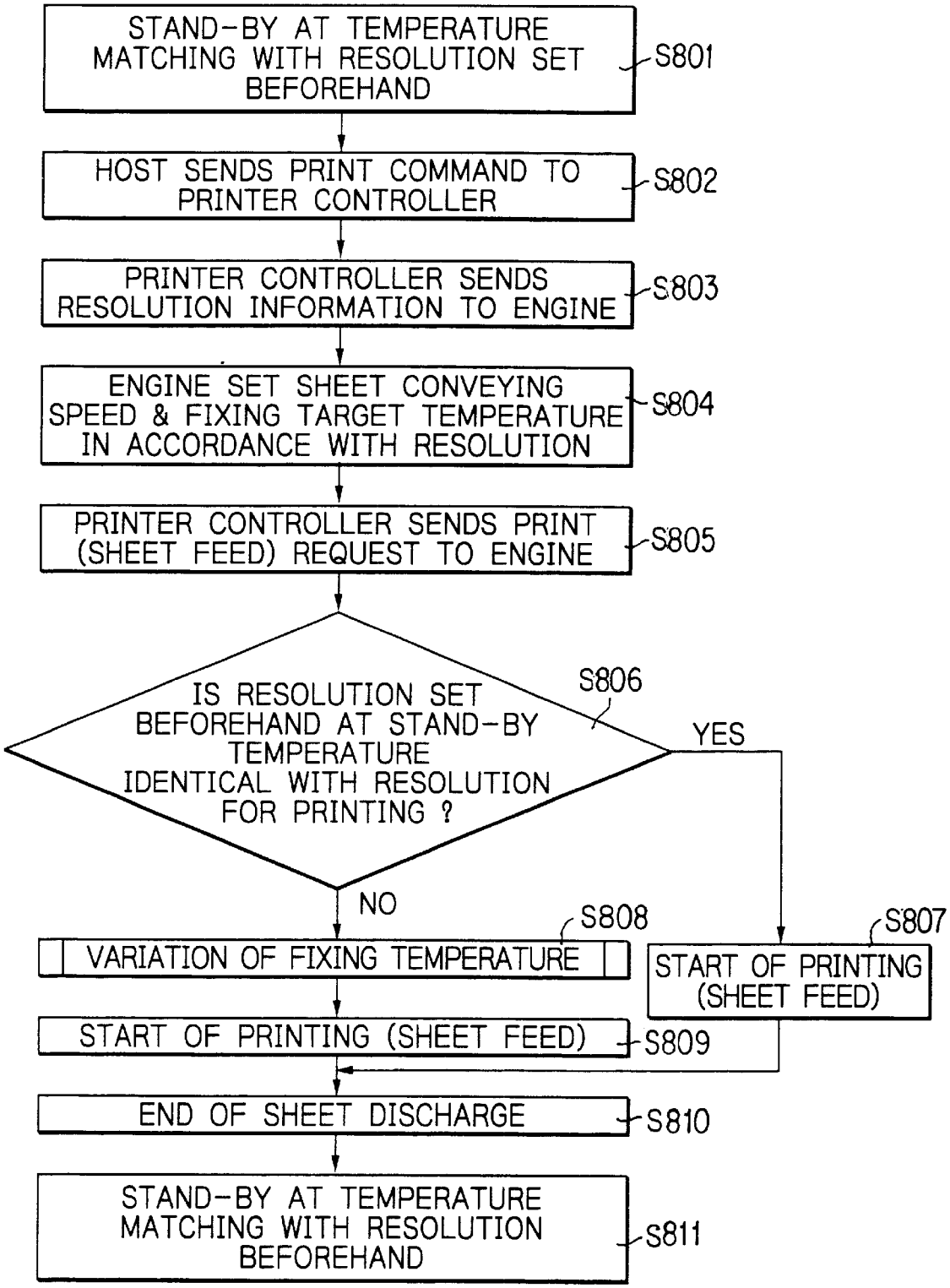
FIG. 8 is a flowchart showing still another specific operation of the illustrative embodiment.

The specific procedure described with reference to FIGS. 5 and 6 varies the target stand-by temperature on the basis of the past conditions of use. This scheme, however, is not fully satisfactory in the following respect. Assume that the stand-by temperature selected corresponds to a sheet conveying speed not frequency used. Then, although the conditions of use may not be far different from each other, the above stand-by temperature may not match with a fixing temperature to be set up later. In such a case, a longer period of time is necessary for the temperature to rise from the stand-by temperature to the fixing temperature, compared to the case wherein the stand-by temperature is adequate. In addition, it is likely that heat available for fixation is short or excessive. FIG. 8 shows another specific procedure available with the illustrative embodiment and setting a stand-by temperature corresponding to a fixing temperature that matches with a sheet conveying speed, or resolution, of frequent use. This specific procedure is also practicable with the configuration of FIGS. 1 through 4 and shares the sequence of steps of FIG. 6 with the previous specific procedures.

As shown in FIG. 8, after the power-up of the printer, the engine 22 sets up a stand-by temperature optimal for a sheet conveying speed set beforehand and matching with a resolution of frequent use (step S801). In response to a print request from the host 50 (step S802), the printer controller 21 issues resolution information to the engine 22 (step S803). In response, the engine 22 sets a sheet conveying speed and a target roller surface temperature (step S804). The print controller 21 the issues a print and sheet feed request to the engine 22 (step S805). Subsequently, whether or not the resolution corresponding to the stand-by temperature set beforehand is identical with the desired resolution is determined (step S806). If the answer of the step S806 is Y, a printing cycle begins (step S807). If the answer of the step S806 is N, then the fixing temperature is varied (step S808). The step S808 is followed by a step S809 for starting a printing cycle.

The resolution issued from the printer controller 21 to the engine 22 is a resolution desired by the operator. So long as that resolution matches with the sheet conveying speed set beforehand and corresponding to the resolution of frequent use, the temperature rises from the stand-by temperature to the target temperature in a short period of time and reduces the operator's waiting time. After the sheet or print has been driven out of the printer (step S810), the engine 22 again selects the stand-by temperature set beforehand (step S811).

Figure 9:
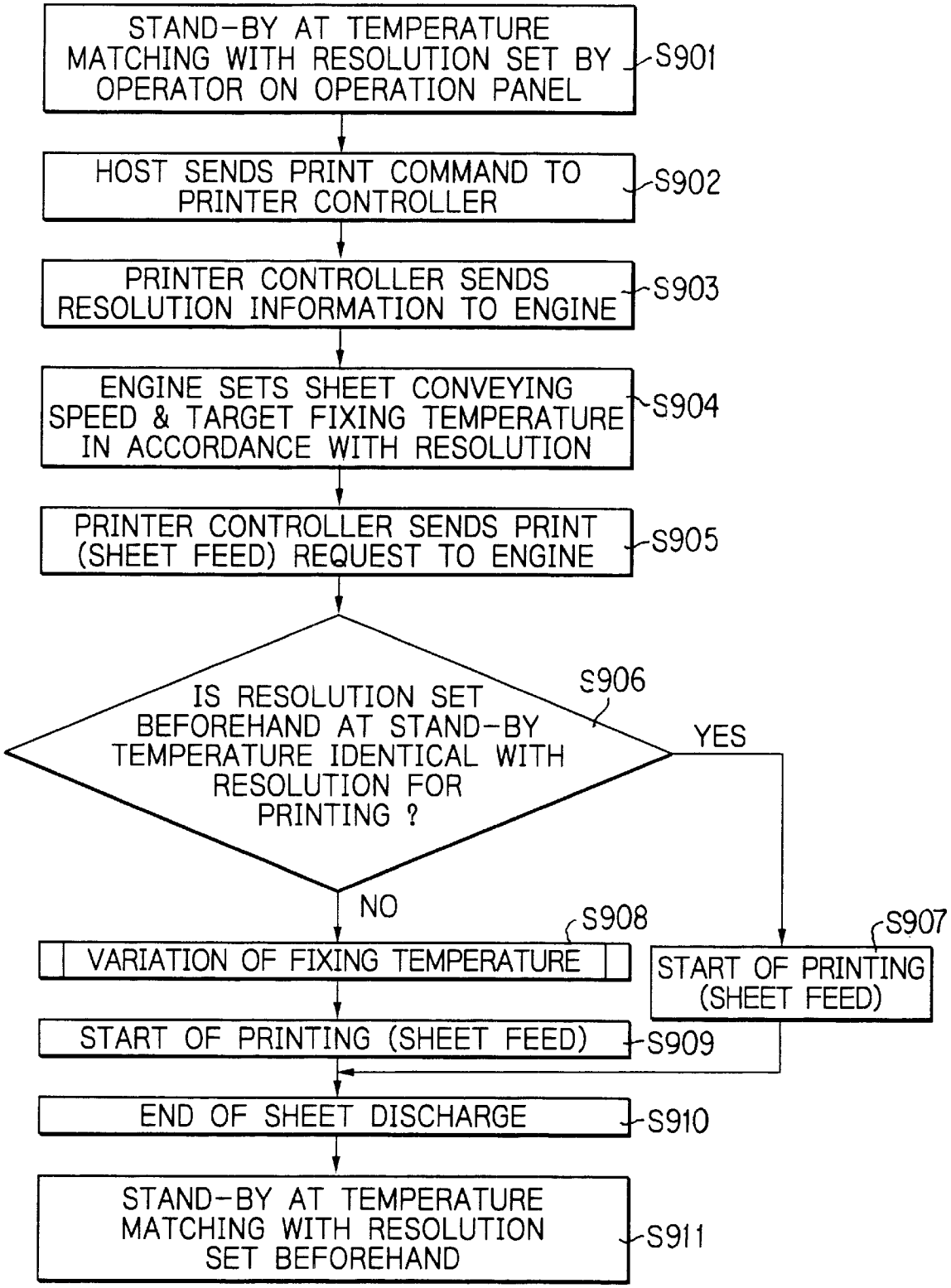
FIGS. 9 and 10 are flowcharts each showing a further specific operation of the illustrative embodiment.
Figure 10:
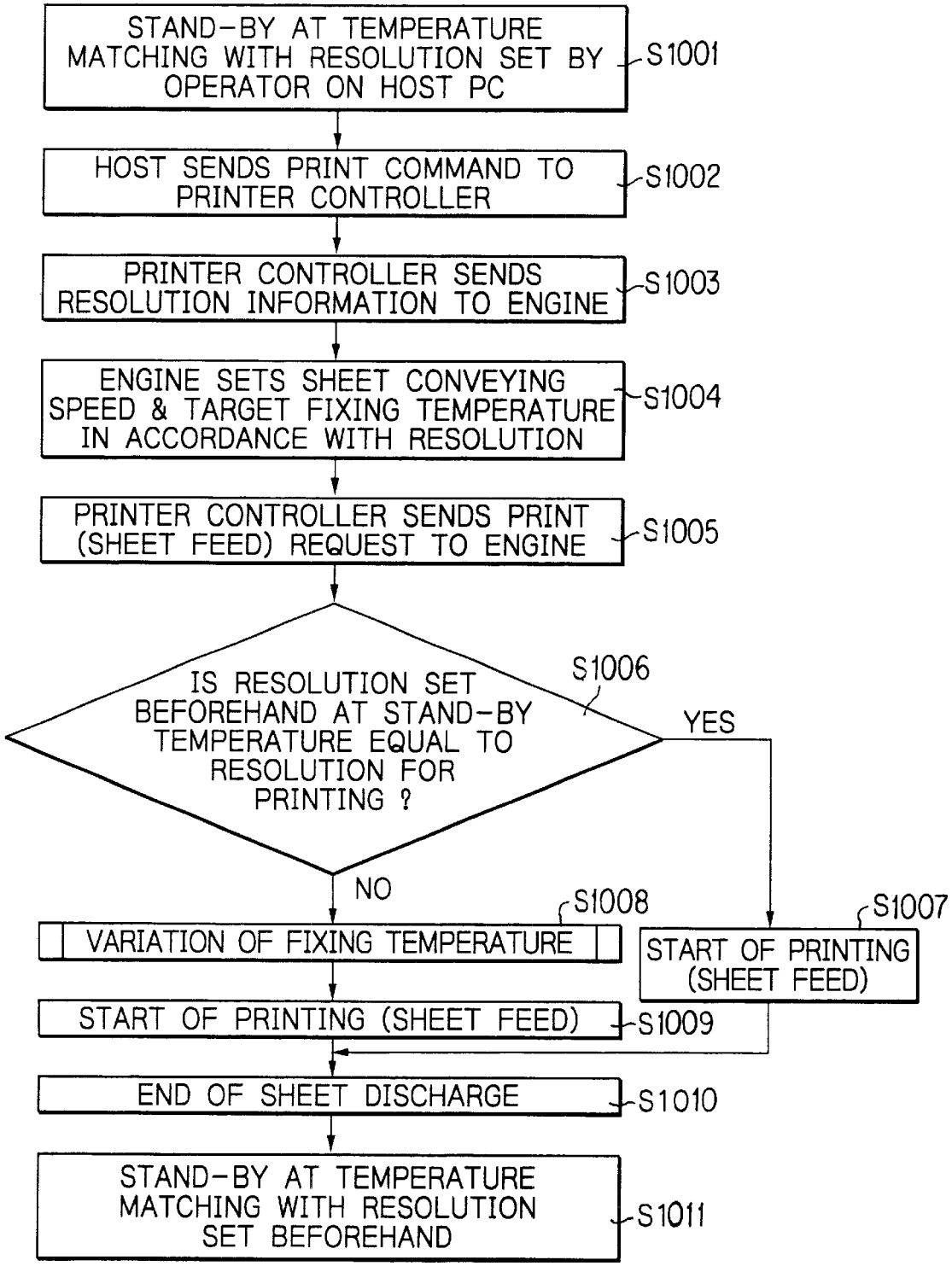

The procedure described with reference to FIG. 8 selects a stand-by temperature matching with a fixing temperature suitable for a resolution and a sheet conveying speed of frequent use beforehand. The resolution of frequent use is determined as a model. In practice, however, the resolution of frequent use differs from one person to another. It may therefore occur that a stand-by fixing unit temperature fixed as a model increases the waiting time for some persons. FIGS. 9 and 10 each show a further specific procedure available with the illustrative embodiment and controlling the stand-by temperature on the basis of the user-by-user resolution of frequent use. These procedures are also practicable with the configuration shown in FIGS. 1 through 4 and share the sequence of steps of FIG. 6 with the previous specific procedures.

Most of the steps shown in FIGS. 9 and 10 are identical to the steps of FIG. 8, specifically the steps S902 through S911, and steps S1002 through S1011, respectively. In FIG. 9, a person is expected to input a resolution of frequent use on the operation panel (step S901). In FIG. 10, a person is expected to input a resolution of frequent use on a personal computer (PC) (step S1001). In either case, after the power-up of the printer, the resolution of frequent use stored in the EEPROM 29 is read out in order to set up a stand-by temperature matching therewith. A printing cycle begins at the stand-by temperature.

The user-oriented setting shown in FIG. 9 or 10 is similarly applicable to the procedure described with reference to FIG. 7. In such a case, the resolution of frequent use will be replaced with the ratio between the frequencies of use of resolutions by a plurality of persons.

The present invention is practicable not only with a fixing unit of the type using heat rollers shown and described, but also with other various types of fixing units, e.g., one using a thermal head, one using a resistor, and one using induction heating. Also, sheet conveying speeds and fixing temperatures shown and described are only illustrative and may be suitably varied in matching relation to a desired machine. Further, the present invention is applicable not only to a printer but also to a copier, a facsimile apparatus or the like including a fixing unit.

In summary, it will be seen that the present invention provides an image forming apparatus having various unprecedented advantages, as enumerated below.

(1) After image formation, a thermal fixing unit sets up a stand-by temperature matching with a resolution selected and controls temperature, thereby reducing a waiting time and applying adequate heat for fixation to a sheet. This solves problems particular to an image forming apparatus capable of varying a sheet conveying speed, but fixing the stand-by temperature of a fixing unit.

(2) The fixing unit sets up a stand-by temperature matching with the history of use and controls temperature. This allows the entire engine to efficiently, rapidly start sheet feed without specifying the stand-by temperature for a particular user. Consequently, there can be reduced the operator's waiting time before sheet feed and the time up to the discharge of a sheet.

(3) When a desired resolution is set beforehand, the stand-by temperature is set in matching relation to a fixing temperature optimal for the above resolution. The entire engine can therefore be efficiently used even when the sheet conveying speed is varied.

(4) If the operator can input a desired stand-by temperature on an operation panel or a host computer, then the image forming apparatus can adequately meet the individual's need.

Various modifications will be possible for those skilled in the art after receiving the teachings of the present disclosure without departing from the scope thereof.

What is claimed is:

1. An image forming apparatus comprising:

a thermal fixing unit, wherein the image forming apparatus is capable of varying a sheet conveying speed, the sheet conveying speed being varied in accordance with a resolution selected, a target fixing temperature of said fixing unit is variable in accordance with the sheet conveying speed, and a stand-by temperature of said fixing unit after image formation is set in accordance with the resolution selected to thereby control a temperature.

2. The apparatus as claimed in claim 1, wherein the set stand-by temperature is written to a nonvolatile memory.

3. An image forming apparatus comprising:

a thermal fixing unit, wherein the image forming apparatus is capable of varying a sheet conveying speed, the sheet conveying speed being varied in accordance with a resolution selected, a target fixing temperature of said fixing unit is variable in accordance with the sheet conveying speed, and a stand-by temperature of said fixing unit after image formation is adequately set in accordance with a history of use of said fixing unit.

4. The apparatus as claimed in claim 3, wherein the set stand-by temperature is written to a nonvolatile memory.

5. The apparatus as claimed in claim 3, wherein the stand-by temperature is input on one of an operation panel and a host computer.

6. The apparatus as claimed in claim 5, wherein the set stand-by temperature is written to a nonvolatile memory.

7. An image forming apparatus comprising:

a thermal fixing unit, wherein the image forming apparatus is capable of varying a sheet conveying speed, the sheet conveying speed being varied in accordance with a resolution selected, a target fixing temperature of said fixing unit is variable in accordance with the sheet conveying speed, and a desired resolution is set beforehand to thereby set and control a stand-by temperature of said fixing unit before and after image formation in accordance with a fixing temperature that matches said resolution.

8. The apparatus as claimed in claim 7, wherein the set stand-by temperature is written to a nonvolatile memory.

9. The apparatus as claimed in claim 7, wherein the stand-by temperature is input on one of an operation panel and a host computer.

10. The apparatus as claimed in claim 9, wherein the set stand-by temperature is written to a nonvolatile memory.

* * * * *